US007216412B2

(12) United States Patent
Vance

(10) Patent No.: US 7,216,412 B2
(45) Date of Patent: May 15, 2007

(54) METHOD FOR CONSTRUCTING AND INSTALLING AN ARMOIRE IN AN EXISTING CLOSET SPACE

(76) Inventor: Oran S. Vance, 554 N. 300 East, American Fork, UT (US) 84003

( * ) Notice: Subject to any disclaimer, the term of this patent is extended or adjusted under 35 U.S.C. 154(b) by 435 days.

(21) Appl. No.: 10/886,203

(22) Filed: Jul. 7, 2004

(65) Prior Publication Data

US 2006/0005506 A1 Jan. 12, 2006

(51) Int. Cl.
*B23P 21/00* (2006.01)
*B23P 17/04* (2006.01)

(52) U.S. Cl. ..... 29/469; 29/401.1

(58) Field of Classification Search ..... 29/469, 29/401.1, 428; 312/298, 321.5, 324, 330.1; 220/529; 211/1

See application file for complete search history.

(56) References Cited

U.S. PATENT DOCUMENTS 1,975,779 A * 10/1934 Church ..... 312/31
2,244,950 A * 6/1941 Jones ..... 312/305
3,955,863 A * 5/1976 Yellin ..... 312/265.2

* cited by examiner

*Primary Examiner*—John C. Hong
(74) *Attorney, Agent, or Firm*—Angus C. Fox, III

(57) ABSTRACT

A method for constructing an armoire within an existing closet space includes the following steps of optionally removing any gypsum board wall sheathing within the closet space; optionally widening the closet opening to more nearly coincide with the interior width dimension of the closet space; optionally raising the height of the closet opening to more nearly coincide with the interior height dimension of the closet space; and constructing an armoire having a body generally in the shape of a rectangular solid that is dimensioned to slide through the closet opening and into the closet space with minimal, non-interference-fit clearance, the armoire having a depth that is about equal the depth of the closet space, the armoire having exterior trim pieces that extend beyond the dimensions of the rectangular solid-shaped body, that fit flush with the closet opening, and that conceal the edges thereof.

20 Claims, 11 Drawing Sheets

METHOD FOR CONSTRUCTING AND INSTALLING AN ARMOIRE IN AN EXISTING CLOSET SPACE

BACKGROUND OF THE INVENTION

1. Field of the Invention

This invention generally relates to armoires, and, more particularly, to armoires constructed within existing closet spaces.

2. Description of the Prior Art

An armoire is generally a large, free-standing wardrobe or movable cupboard having doors and shelves or drawers. Versatile pieces of furniture that originated in Europe more than 500 years ago, armoires can be designed to hold clothing, china, computer equipment, audio equipment, televisions, audio/visual media collections, photo albums, can make itself at home in nearly any room of the house. Regardless of what they might hold, armoires are typically aesthetic focal points. They can be made of many types of solid wood, or laminated materials, to which a plethora of new or antique finishes can be applied, including both stain and paint finishes. In the U.S., where it has become customary to incorporate at least one clothes closet in each bedroom of every home and apartment, armoires have been relatively uncommon. In places, such as Europe, which have still not developed a closet mentality, multiple armoires are found in nearly every residence.

There are two principal problems with closets. The first is that space is typically not efficiently utilized. The second is that closets, as a general rule, are internally unattractive. In addition, closet doors are seldom attractive. Three types of closet doors are commonly used: standard side-hinged, bifold, and sliding. Sliding doors are probably the least attractive. Bifold doors often look cheap. The standard side-hinged doors can be an expensive solid wood door, a cheap hollow-core door, or anything in between.

There are also problems associated with armoires. When used as a closet substitute, an armoire must be at least 25 inches deep so that it may hold coats. Such a depth is considerably greater than the depth of most other pieces of bedroom furniture. Hence, it may be difficult to arrange an armoire so that it is coordinated with other furniture and so that only a minimum amount of floor space on either side of it is made unuseable. An additional problem is the typically high costs of armoires. Because an armoire must be of furniture grade quality on at least three side (i.e., the front and both sides), the cost of manufacture is typically at least as much as furniture of comparable size. Still yet another problem is that most armoires have a footprint that is considerably less than a standard size closet. Thus several armoires might be required as substitutes for a single closet.

SUMMARY OF THE INVENTION

The present invention solves the problems of both closets and armoires by providing a method for constructing an armoire within an existing closet space. The invention also includes certain armoire design features that enhance the utility of and space utilization within the armoire.

The method for constructing an armoire within an existing closet space includes the following steps: optionally removing any gypsum board wall sheathing within the closet space; optionally widening the closet opening to more nearly coincide with the interior width dimension of the closet space; optionally raising the height of the closet opening to more nearly coincide with the interior height dimension of the closet space; constructing an armoire having a body generally in the shape of a rectangular solid that is dimensioned to slide through the closet opening and into the closet space with minimal, non-interference-fit clearance, the armoire having a depth that is about equal the depth of the closet space, the armoire having exterior trim pieces that extend beyond the dimensions of the rectangular solid-shaped body, that fit flush with the closet opening, and that conceal the edges thereof.

For closet openings having a width that is a multiple of at about 17 to 25 inches, pull-out clothes hangar pole assemblies may be installed within the armoire. For such assemblies, the clothes hanger rod of each assembly is perpendicular to the front face of the unit. Drawers may also be incorporated into the armoire.

DETAILED DESCRIPTION OF THE PREFERRED EMBODIMENTS

The present invention provides a method for constructing an armoire within an existing closet space. The invention also includes certain armoire design features that enhance the utility of and space utilization within the armoire. The invention will now be described with reference to the included drawing figures. It should be understood that the drawings are merely illustrative of the invention, and are not necessarily drawn to scale. In addition, no attempt is made to represent the level of detail and decoration expected of millwork carpenters by contemporary consumers. Such decorative detail varies widely and is well known in the art. It is assumed that the armoire will be built within a closet opening in a structure characterized as having hollow walls framed with vertical spaced-apart studs and horizontal top and bottom plates and covered with sheathing, such as gypsum board, lathe and plaster, or paneling. The studs and top and bottom plates can be 2×4 or 2×6 scantling or metal box sections.

The invention will now be described with reference to the included drawing figures. Item numbers followed by a dash "–" and a letter are identical items. The letter after the dash merely serves to indicate the item's installed position.

Figure 1:
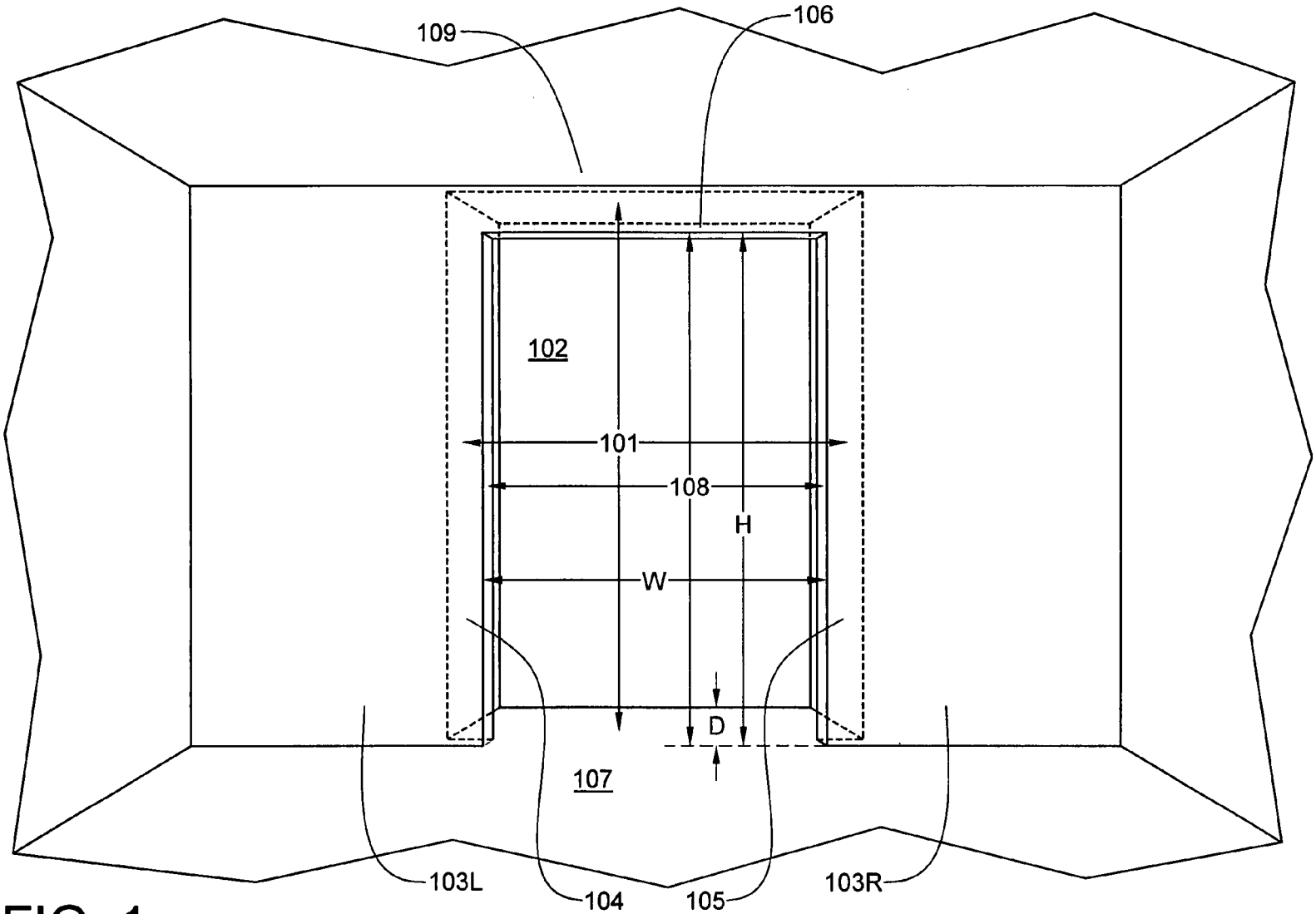
FIG. 1 is an isometric view of a typical existing closet space from which the doors have been removed.

Referring now to FIG. 1, the method for constructing an armoire within an existing closet space 101 begins with the removal of doors (not shown) from the closet space 101. Most conventional closet spaces have a depth D of about 28 inches, which is measured from the rear wall 102 of the closet to a line drawn from the outer surface of the left closet entrance wall 103L to the outer surface of the right closet entrance wall 103R. It will be noted that most closets have a left wall extension 104, a right wall extension 105, and an upper wall extension 106, which together with the floor 107, form a closet opening 108 having a height H that is shorter and a width W that is narrower than the closet space 101. Although an armoire may be built which fits within such a constricted closet opening 108, interior closet space behind the wall extensions 104, 105 and 106 would not be utilized, resulting in wasted space. The ceiling 109, forms the top of closet space 101.

Figure 2:
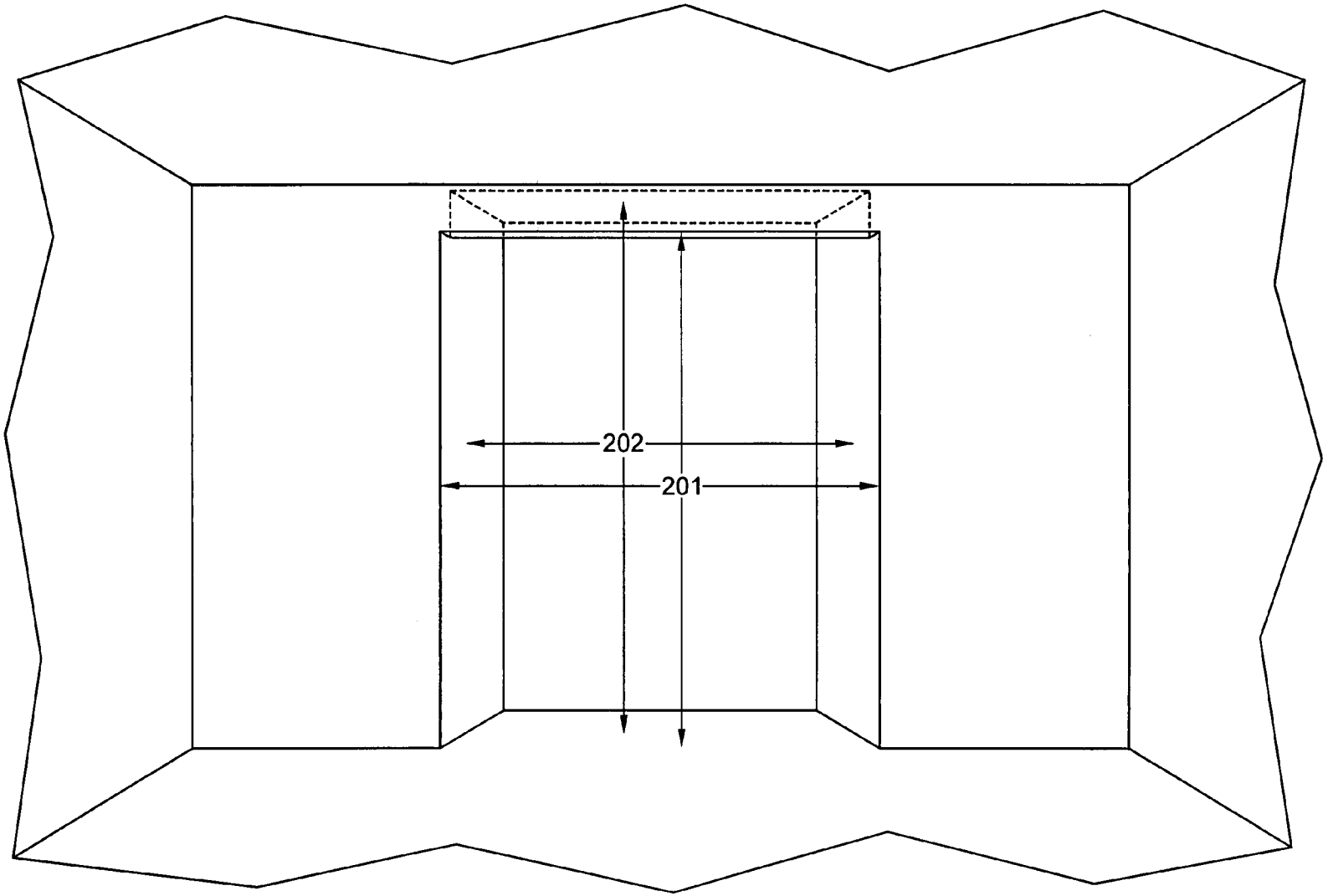
FIG. 2 is an isometric view of the existing closet space of FIG. 1, which has been altered to remove the right and left wall extensions.

Referring now to FIG. 2, the left wall extension 104 and the right wall extension 105 have been removed from the existing closet space 101 of FIG. 1. For hollow wall construction, removal involves ripping out studs, trimming bottom and top plates, and removing sheathing from which the wall extensions are formed. The modified closet opening 201 provides a larger space 202 in which to install an armoire.

Figure 3:
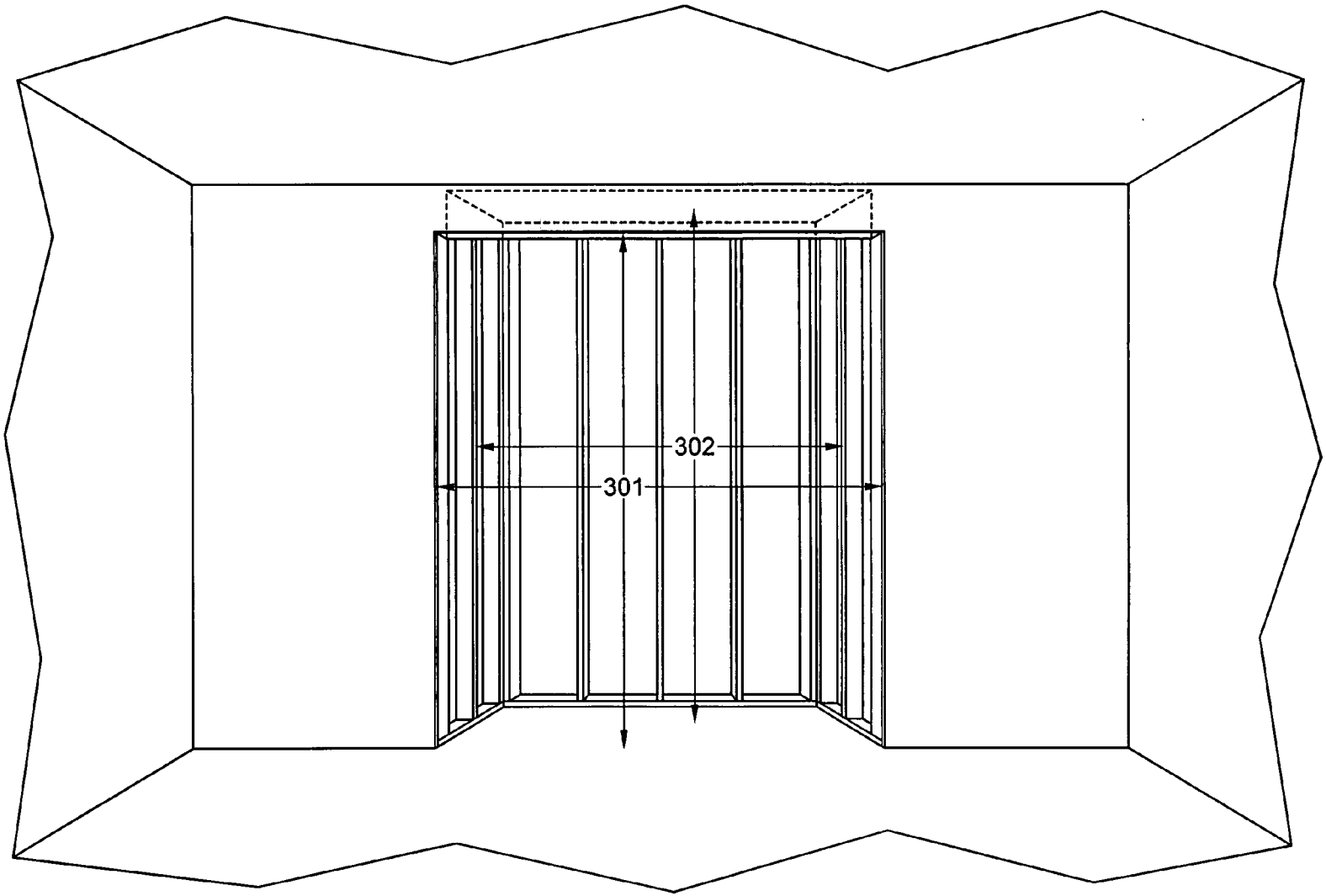
FIG. 3 is an isometric view of the existing closet space of FIG. 2, which has been altered to remove the gypsum board covering where the armoire is to be installed.

Referring now to FIG. 3, the closet space 101 of FIG. 1 and the modified closet opening 201 of FIG. 2 have been further modified by removing the sheathing where the armoire is to be installed. As gypsum board sheathing typically has a thickness of either 0.50 or 0.625 inch, the modified closet opening 301 is increased in width by at least 1.0 inch and increased in height by at least 0.5 inch. In addition, the depth of the resulting closet space is increased by at least 0.5 inch. Consequently, a larger armoire may be constructed. Although the remaining upper wall extension 106 will prevent the installation of a floor to ceiling armoire, for most applications, this configuration will provide the most aesthetically pleasing result, as the armoire will have a height identical to that of existing doors in the building. As a general rule, only in office buildings are doors of near ceiling height frequently utilized. For most residential construction, doors are usually less than ceiling height, being about 80 inches in height.

Figure 4:
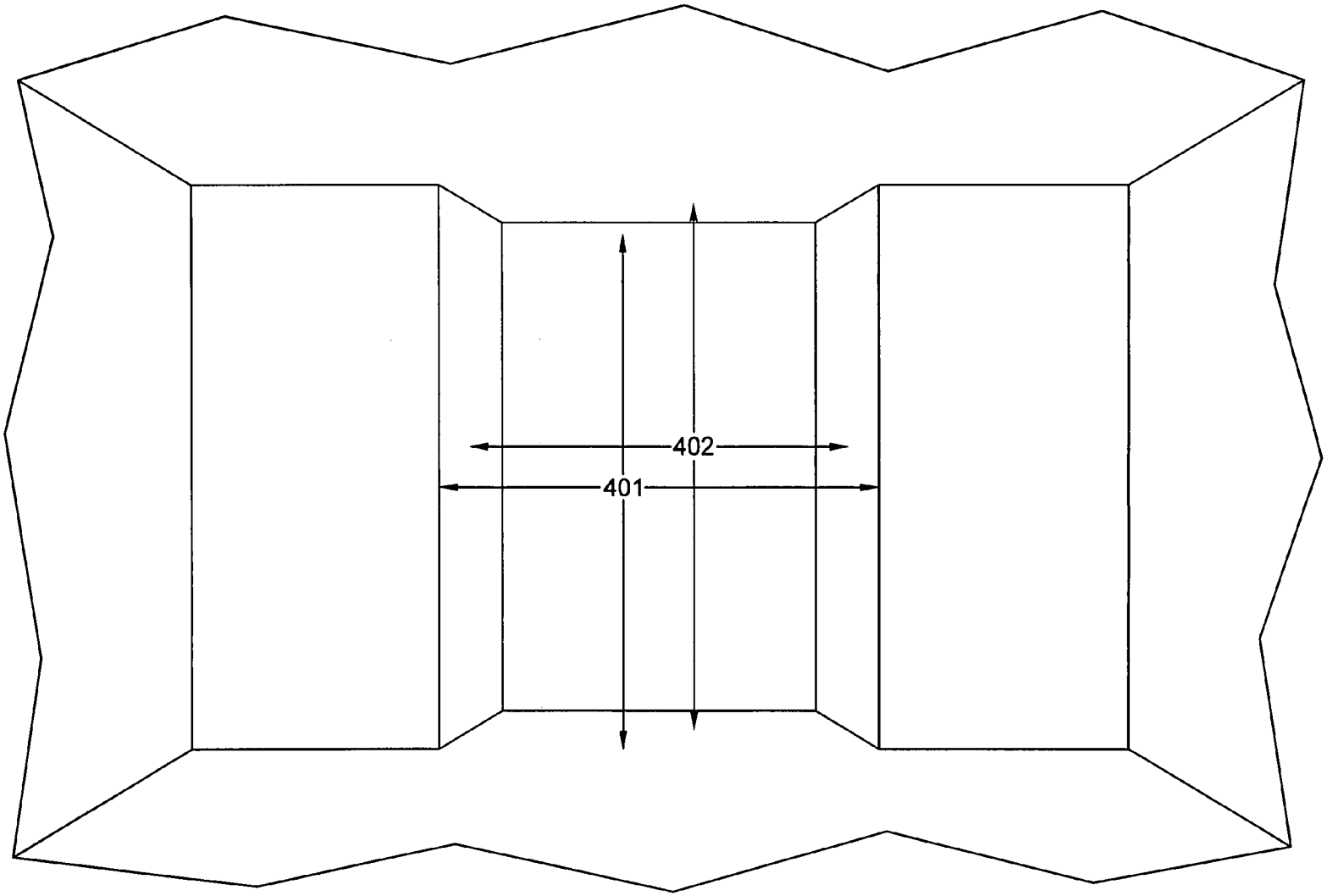
FIG. 4 is an isometric view of the existing closet space of FIG. 1, which has been altered to remove the upper, right and left wall extensions.

Referring now to FIG. 4, the closet space 201 of FIG. 2 has been further altered by removing the upper wall extension 106. This configuration provides a resulting closet opening 401 and a closet space 402 of maximum size in which to install an armoire. However, as heretofore explained, unless the structure has ceiling height doors, such a configuration is not deemed to be aesthetically optimized. It should be clear that the entire wall extension 106 need not be removed, and that only a portion of it may be removed. In addition, as in FIG. 3, the gypsum board sheathing may also be removed to further increase the size of the closet space 402.

Figure 5:
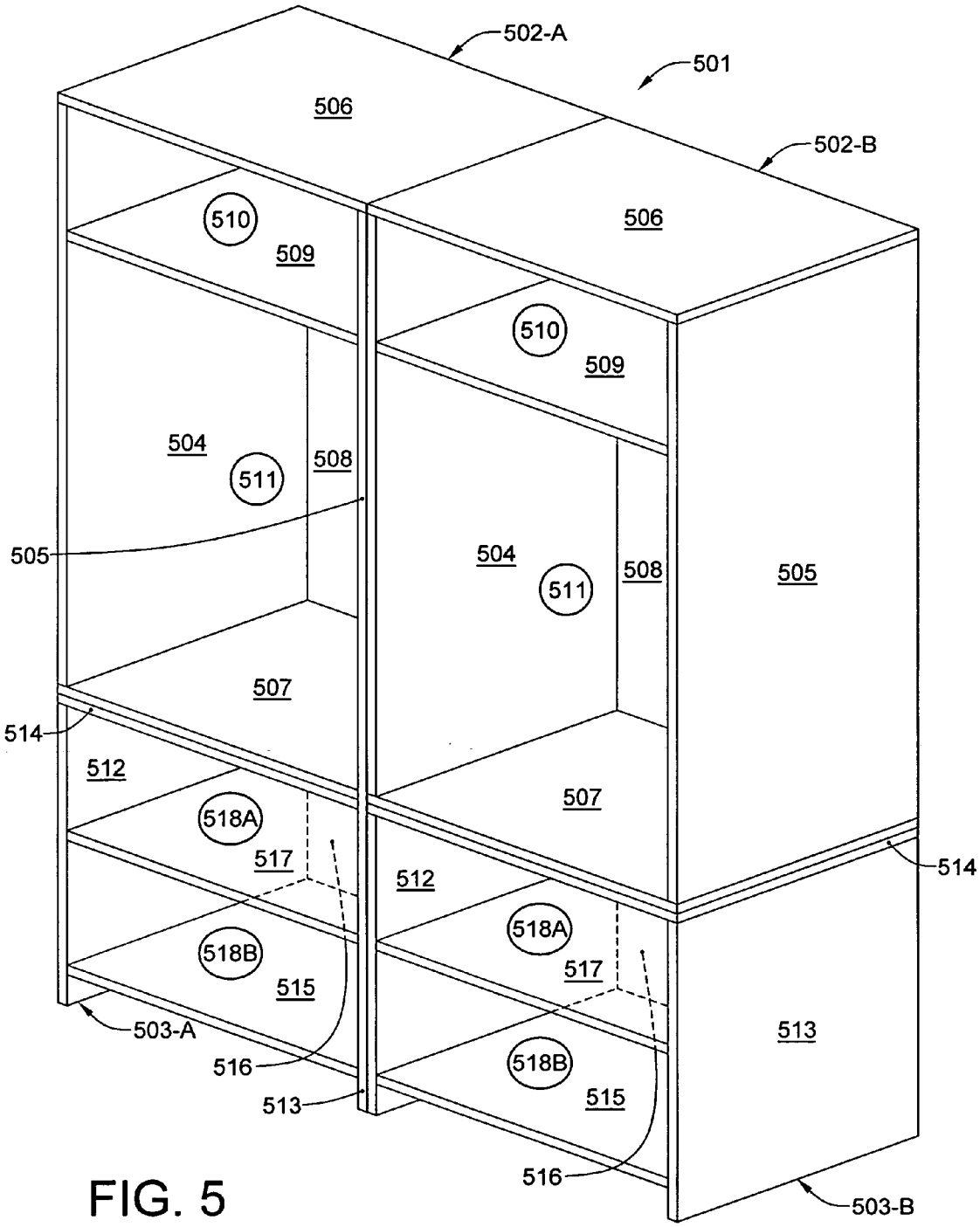
FIG. 5 is an isometric view of the interior of an armoire built to fit within the existing closet space of FIG. 3.

Referring now to FIG. 5, an armoire housing 501 has been constructed that is dimensioned to fit within the existing closet space 301 of FIG. 3. If the closet opening has a height H, a width W and the closet space has a depth D, the housing 501 is typically constructed so that it has a height (H—~0.5 cm), a width (W—~1.0 mm) and a depth (D—~0.5 cm). The reduction of each of each critical dimension by about (~) 0.5 to 1.0 cm is made to compensate for any irregularities related to out-of-square, out-of-plumb, and warped stud conditions in the closet space 301 as constructed, and to also ensure that the housing 501 slides into the existing closet space 301 without interference. Although greater clearances may be used, 1.0 mm is deemed to be the preferred amount for closet spaces built by competent and conscientious workmen. The armoire housing 501 has not yet been fitted with doors or drawers. For ease of assembly from a weight perspective, the armoire housing 501 has been constructed from a first set of two identical upper subunits 502-A and 502-B and a second set of two identical lower subunits 503-A and 503-B, which are secured together with adhesive, screws, or a combination of the two.

Each upper subunit 502-A or 502-B has a left side panel 504, a right side panel 505, a top panel 506, a lower panel 507, a back panel 508, and an upper shelf 509. The horizontal cavities 510 above the upper shelves 509 are intended for storage, while the large rectangular cavities 511 below the upper shelves 509 are intended as a storage space for clothing hanging from at least one horizontal pole. Doors (not shown in this view) affixed to the vertical edges of the each upper subunit 502-A and 502-B will cover the horizontal cavities 510 above the upper shelves 509 and the large rectangular cavities 511.

Each lower subunit 503-A or 503-B has a left side panel 512, a right side panel 513, a top panel 514, a lower panel 515, a back panel 516, and a shelf 517 between the top panel 514 and the lower panel 515. A drawer (not shown in this view) will be installed within each recess 518A and 518B formed by the shelf 517.

Figure 6:
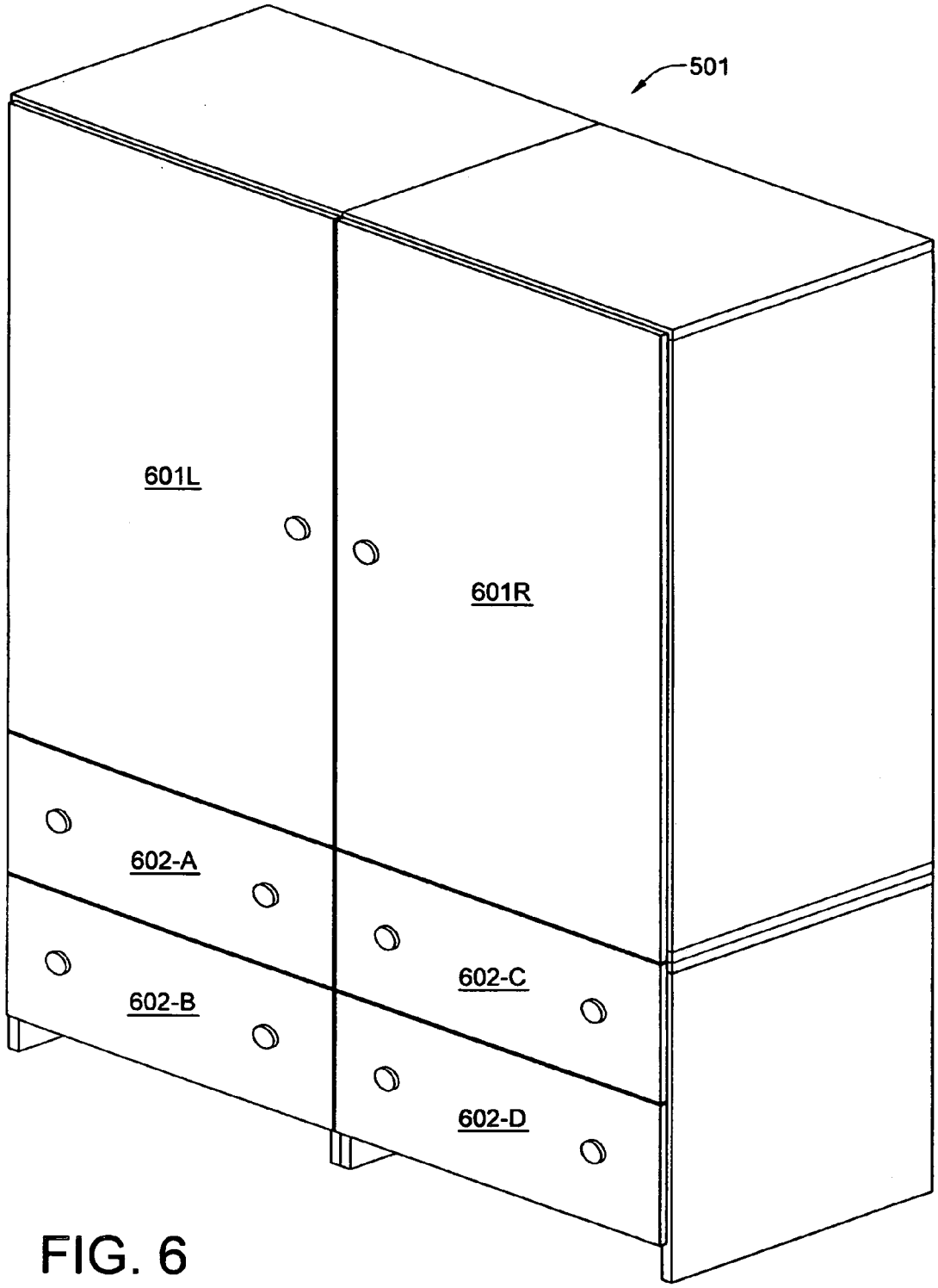
FIG. 6 is an isometric view of the armoire of FIG. 5 after the installation of doors and drawers.

Referring now to FIG. 6, the armoire housing 501 of FIG. 5 is shown after the installation of doors (601L and 601R) and drawers 602-A, 602-B, 602-C and 602-D (602, generally). Full extension drawer glides are used to enable the drawers 602 to be fully withdrawn from their respective recesses 518A and 518B.

Figure 7:
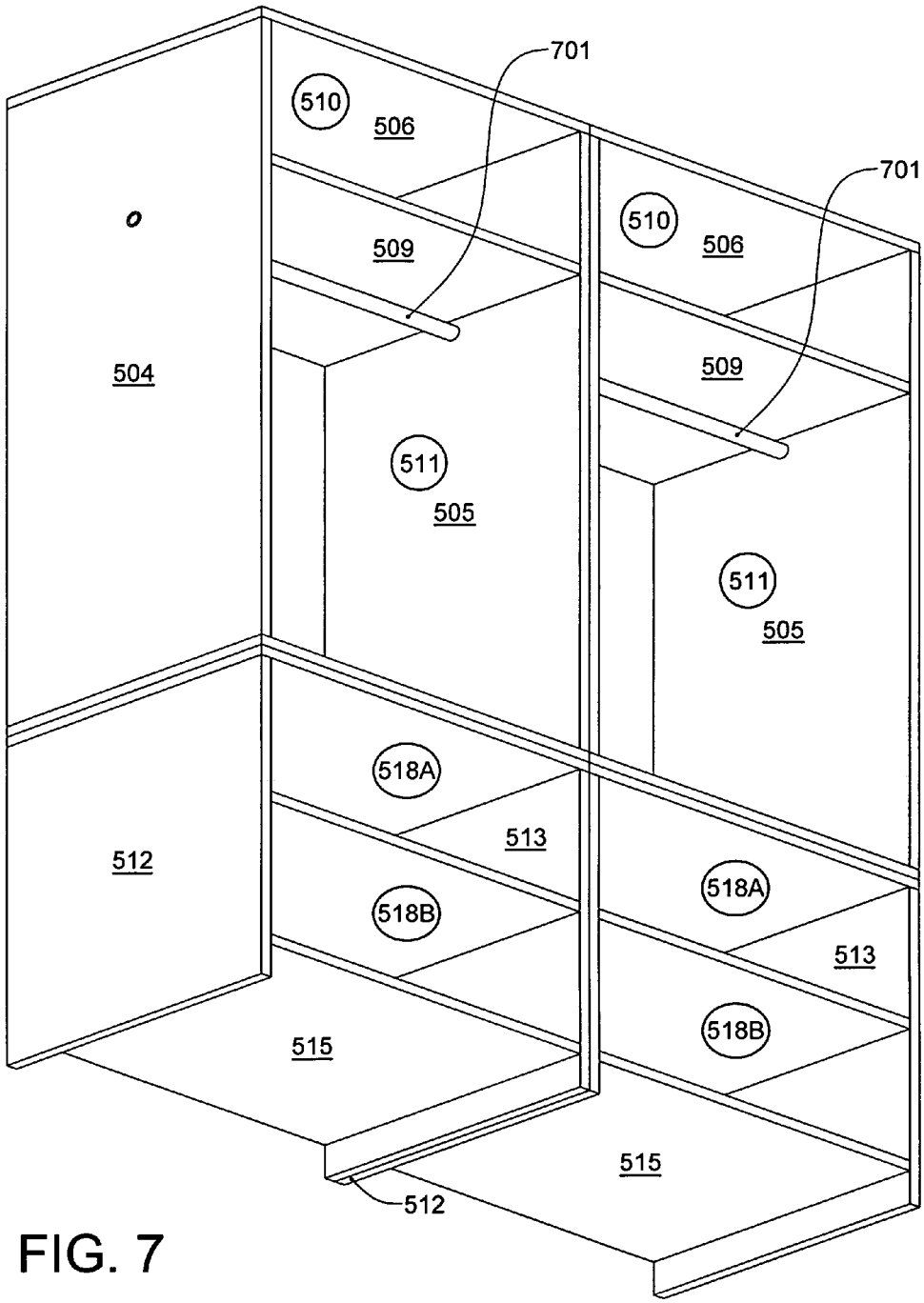
FIG. 7 is an isometric view of the interior of the armoire of FIG. 5 with a conventional clothes hangar pole installed therein.

Referring now to FIG. 7, each of the armoire housing upper subunits 502-A and 502-B of FIG. 5 has been fitted with a conventional clothes hangar pole 701. Articles of clothing, such as shirts, blouses, slacks, skirts and dresses will be placed on hangars that are parallel to the sides 504 and 505 of the subunits 502-A and 502-B.

Figure 8:
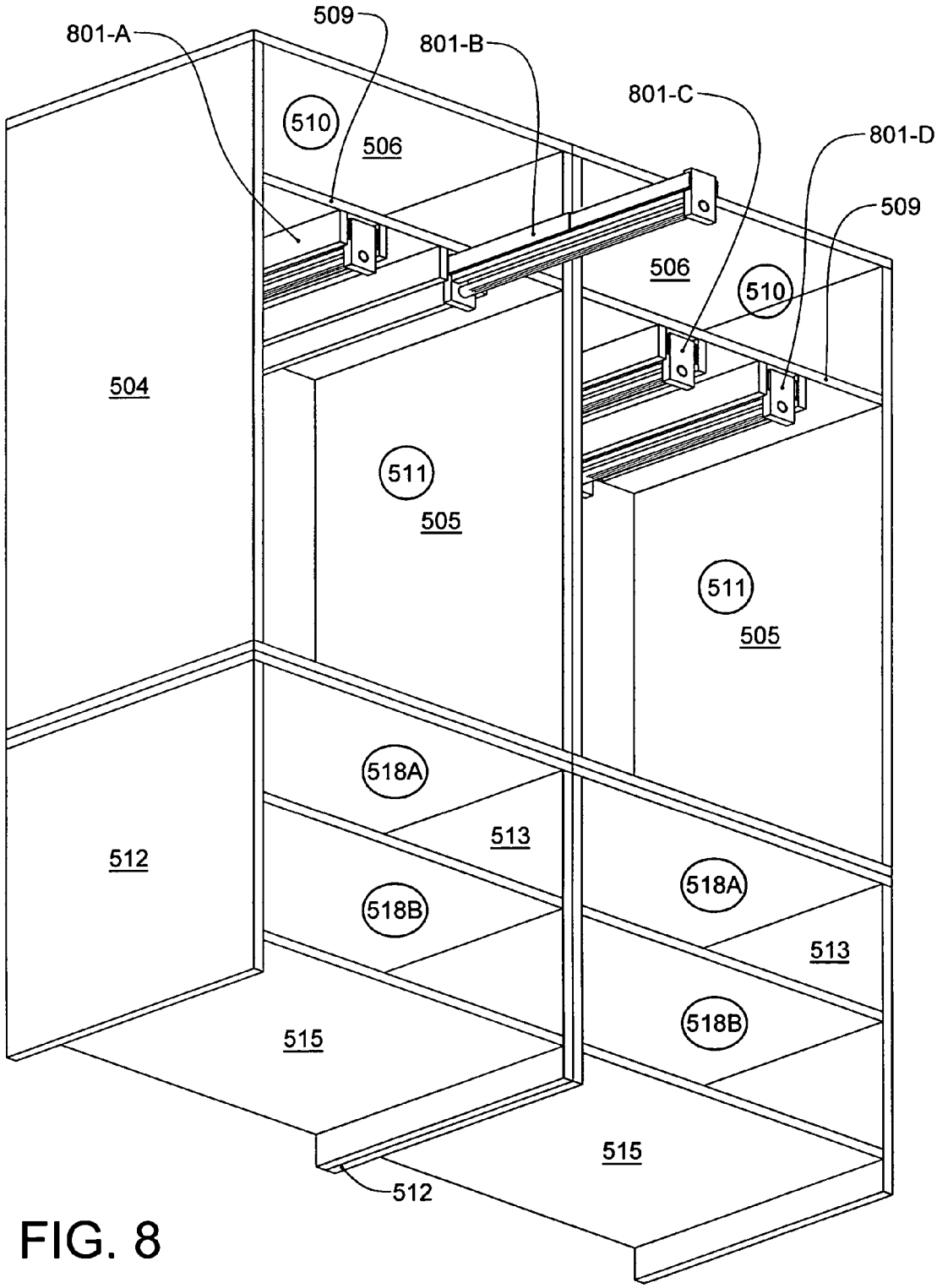
FIG. 8 is an isometric view of the interior of the armoire of FIG. 5 with four pull-out clothes hangar pole assemblies installed therein.

Referring now to FIG. 8, each of the armoire housing upper subunits 502-A and 502-B of FIG. 5 has been fitted with two pull-out clothes hanger tube assemblies 801-A, 801-B, 801-C and 801-D. Pull-out clothes hanger tube assemblies 801-A, 801-C and 801-D are shown fully-retracted, while clothes hanger tube assembly 801-B is shown fully-extended.

Figure 9:
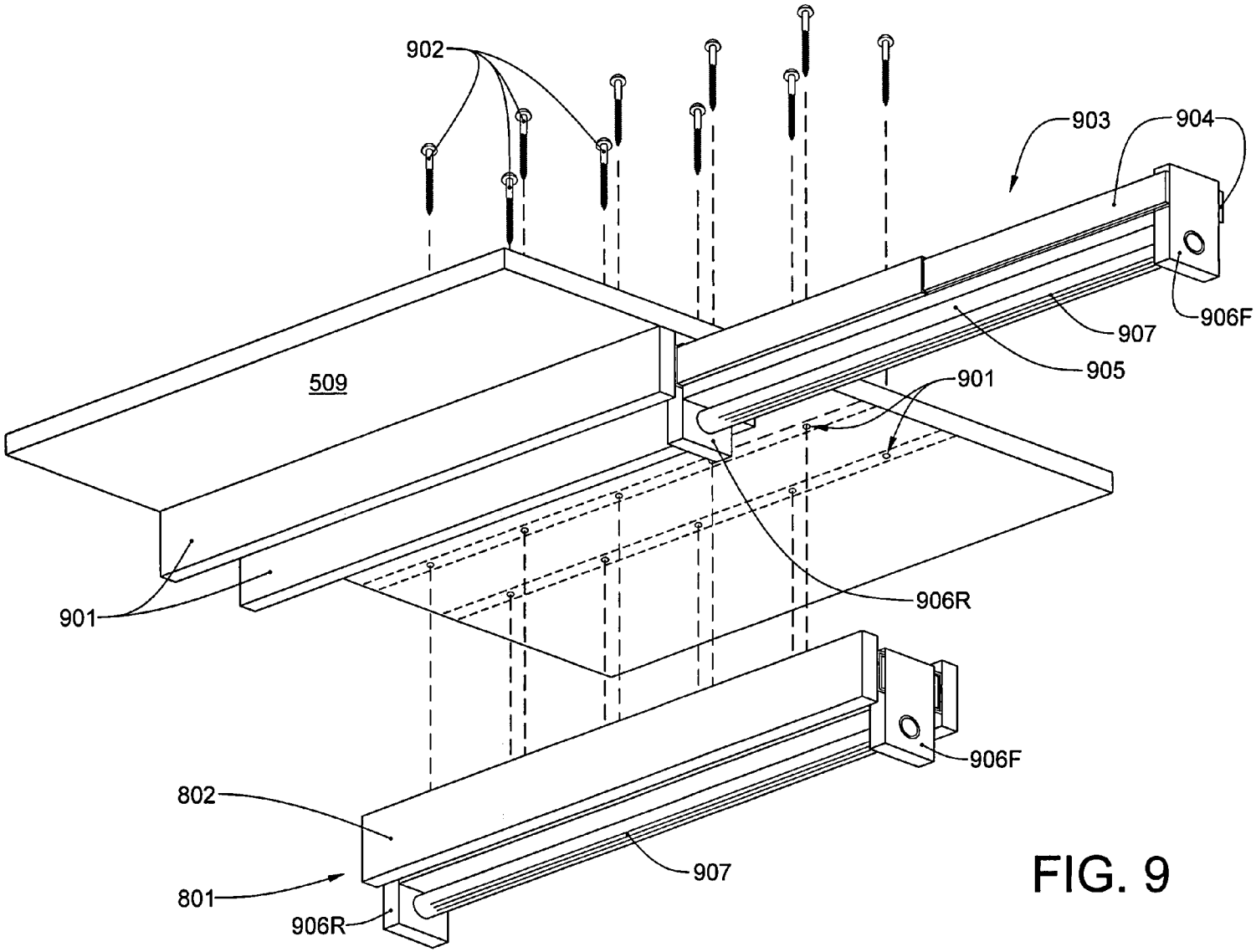
FIG. 9 is a closeup isometric view of a pair of pull-out clothes hangar pole assemblies.

Referring now to FIG. 9, each pull-out clothes hanger pole assembly 801 includes a pair of spaced-apart support planks 901, which are secured to a horizontal panel of the armoire, such as the upper shelf 509 with screws 902, a horizontally-slideable pole unit 903 which is coupled to the support planks 901 via a pair of full-extension drawer glides 904. Full-extension drawer glides typically have three telescoping tracks. When fully retracted, each of the tracks fully overlap. When the glide is fully extended, each half of the middle track overlaps with half of one of the other tracks, thereby rigidly coupling all three tracks together. Each horizontally-slideable pole unit 903 includes a carrier block 905, of rectangular cross section, front and rear end pieces 906F and 906R respectively, which are attached to opposite ends of the carrier block 905, and a hangar pole 907 that is suspended between the front and rear end pieces 906F and 906R. It should be obvious that a pull-out clothes hanger pole assembly may be constructed in a variety of ways. With the appropriate tooling, the assembly, including full-extension glides, may be fabricated from sheet metal and assembled as a single unit. In any case, the pull-out clothes hanger pole assemblies 801 permit more efficient space utilization within the armoire. For example, assuming that an armoire housing subunit 502-A or 502-B has an interior depth of about 27 inches and an interior width of about 34 inches. Using a single conventional closes hangar pole, about 34 inches are available for hanging articles of clothing. However, using two pull-out clothes hanger assemblies 801, about 54 inches are available for hanging articles of clothing. This equates to about a 59 percent increase in space available to hang articles of clothing. Space utilization is maximized when the available width of a subunit 502-A or of a single-unit armoire is evenly divisible into spaces which are 17 to 24 inches wide. As the spaces approach 28 inches in width, there is little to be gained by the use of pull-out clothes hanger assemblies 801.

Figure 10:
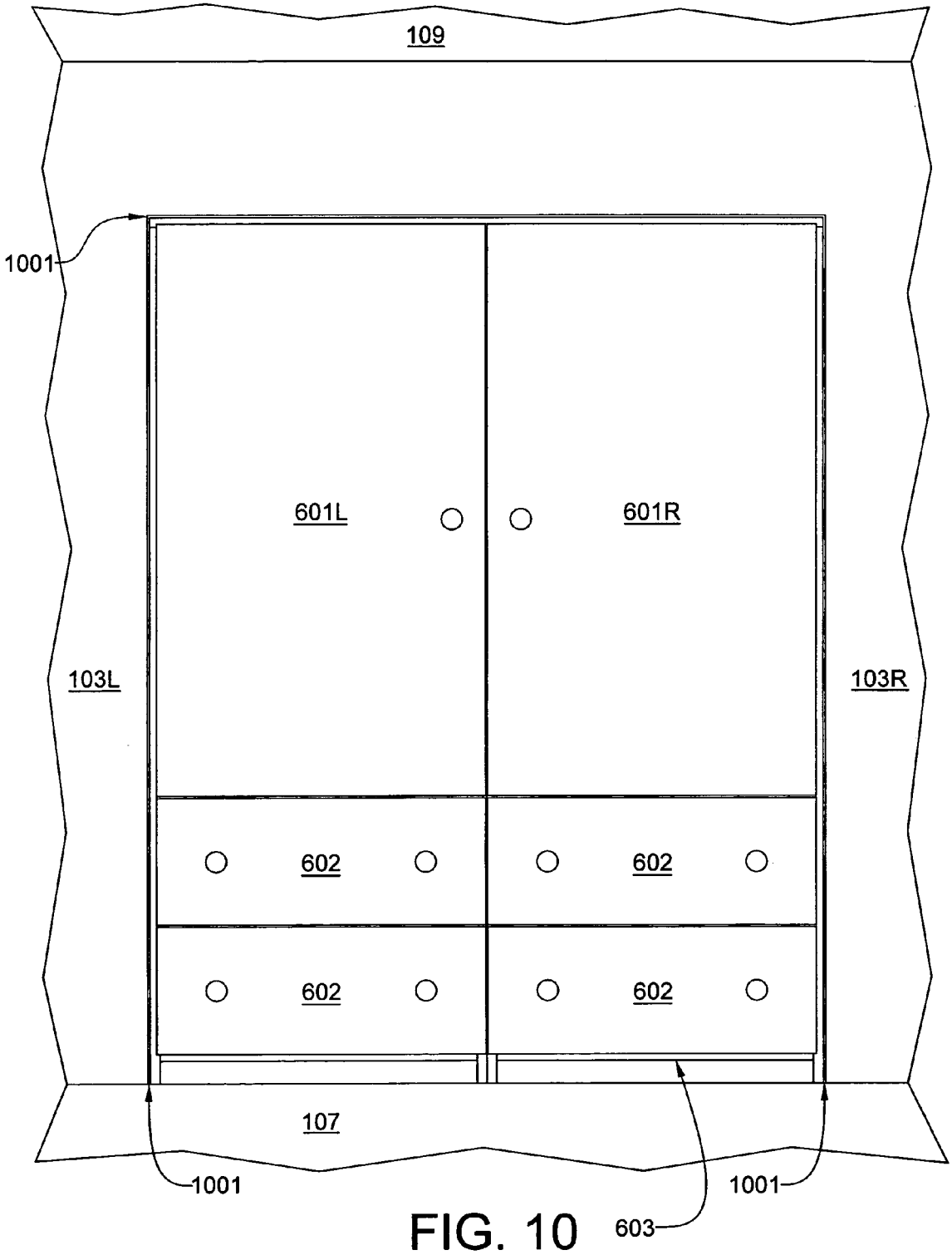
FIG. 10 is a front elevational view of the armoire of FIG. 6, following installation in the closet space of FIG. 3.

Referring now to FIG. 10, the armoire 601 of FIG. 6 has been installed in the existing closet space 301. Also shown in this view are the left closet entrance wall 103L, the right closet entrance wall 103R, the floor 107 and the ceiling 109. It will be noted that, as the housing 501 has a height (H—~0.5 cm), a width (W—~1.0 cm) and a depth (D—~0.5 cm), some clearance 1001 is visible between the left closet entrance wall 103L and the left side of armoire 601, between the right closet entrance wall 103R and the right side of armoire 601 and between the upper wall extension 106 and the top of armoire 601.

Figure 11:
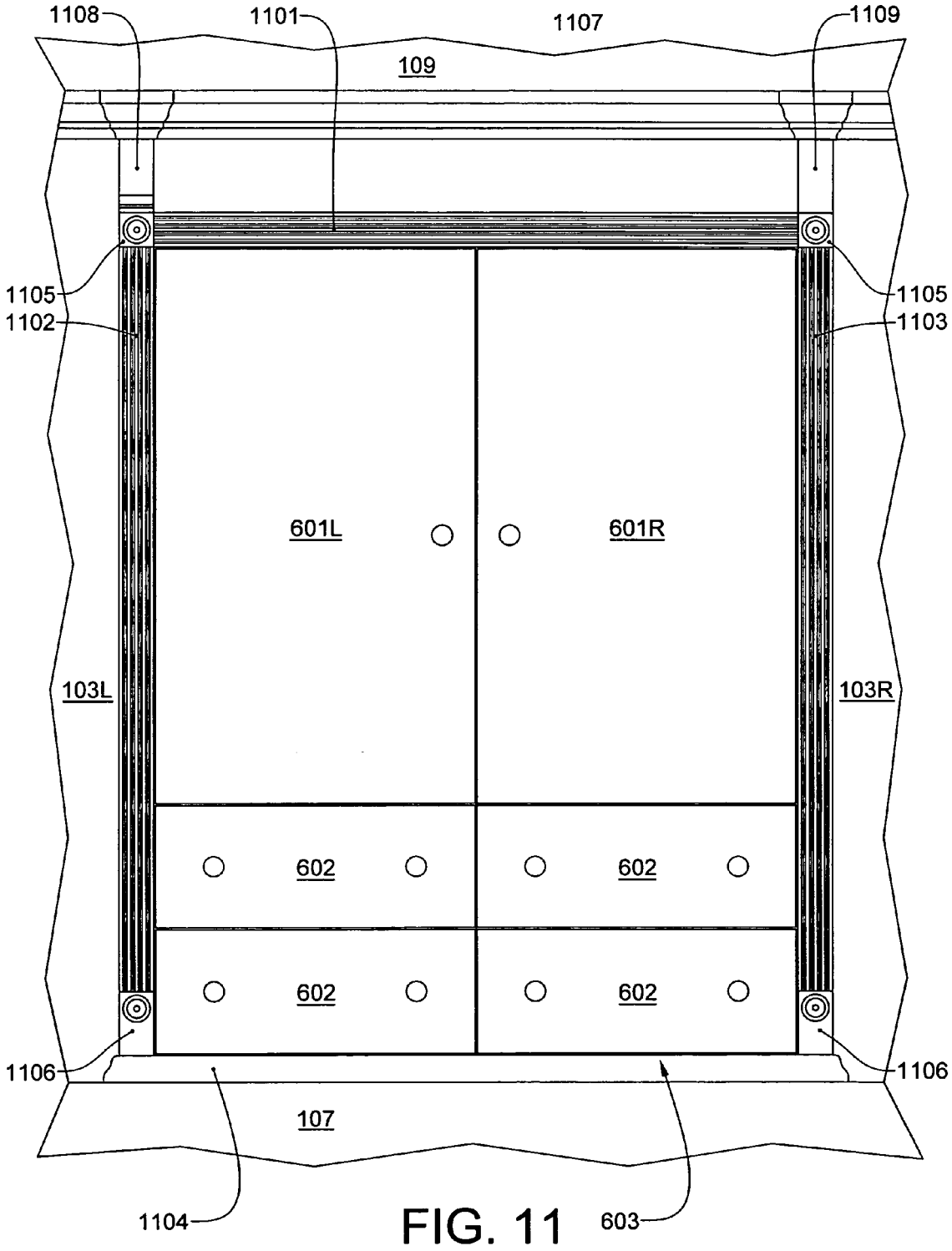
FIG. 11 is a front elevational view of the installed armoire of FIG. 10 following the addition of perimetric trim pieces.

Referring now to FIG. 11, the armoire 601 of FIG. 6 has been installed in the existing closet space 301 and an upper trim piece 1101, a left-side trim piece 1102, a right-side trim piece 1103, and a toe kick trim piece 1104 have been installed to cover the joints between the closet space opening 904 and the armoire 601. In addition, decorative corner trim pieces 1105 have been placed at the intersection of the upper trim 1101 with the left-side and right-side trim pieces 1102 and 1103, respectively. A lower decorative trim piece 1106 has been placed between the bottom of the left-side trim piece 1102 and the toe-kick trim piece 1104 and between the bottom of the right-side trim piece 1103 and the toe-kick trim piece 1104. Also shown in this view is a crown molding 1107 positioned where the ceiling 109 and the upper wall extension 106 intersect. Additional trim pieces 1108 and 1109 have been placed above each decorative corner trim piece 1105, which tie into the crown molding 1107.

Although only several embodiments of the invention have been disclosed herein, it will be obvious to those of ordinary skill in the art, that changes and modifications may be made thereto, without departing from the spirit and scope of the invention as hereinafter claimed.

What is claimed is:

1. A method for constructing an armoire which fits within an existing closet space, said closet space having a generally rectangular opening into a room, said method comprising the steps of:

constructing an armoire having a body generally in the shape of a rectangular solid that is dimensioned to slide through the generally rectangular opening and into the closet space with minimal, non-interference-fit clearance, the armoire having a depth that is about equal the depth of the closet space;

introducing the armoire into the closet space; and affixing the armoire to the generally rectangular opening.

2. The method of claim 1, which further comprises the step of removing any gypsum board wall sheathing within the closet space.

3. The method of claim 1, which further comprises the step of widening the generally rectangular opening to more nearly coincide with an interior width dimension of the closet space.

4. The method of claim 1, which further comprises the step of raising the height of the generally rectangular opening to more nearly coincide with an interior height dimension of the closet space.

5. The method of claim 1, which further comprises the step of attaching exterior trim pieces to outer edges of the armoire, said trim pieces covering any gaps existing between the armoire and said generally rectangular opening.

6. The method of claim 1, which further comprises the step of constructing the armoire as multiple subunits, which are subsequently secured together as a single unit.

7. The method of claim 1, which further comprises the step of providing at least one cavity equipped with a horizontal pole, from which clothes may be suspended on hangars.

8. The method of claim 7, wherein said armoire has at least one rear panel, and said horizontal pole is parallel to said at least one rear panel.

9. The method of claim 7, wherein said armoire has at least one rear panel and at least two horizontal poles perpendicular to said at least one rear panel.

10. The method of claim 9, wherein said horizontal pole is part of a pull-out clothes hanger pole assembly having a horizontally-slideable pole assembly.

11. The method of claim 10, wherein said pull-out clothes hanger pole assembly is attached to a horizontal panel of the armoire and has full-extension glides which permit the horizontally-slideable pole assembly to be extended completely outside the armoire.

12. A method for constructing an armoire which fits within an existing closet space, said closet space having a generally rectangular opening into a room, said method comprising the steps of:

constructing multiple subunits, each subunit having an upper panel, a lower panel, a left-side panel, right-side panel, and a rear panel, each subunit having at least one shelf extending between said left-side panel and said right-side panel;

securing said subunits together to form an armoire housing, said armoire housing dimensioned to slide through the generally rectangular opening and into the closet space with minimal, non-interference-fit clearance, the armoire having a depth that is about equal the depth of the closet space;

introducing the armoire housing into said generally rectangular opening; and affixing the armoire to the generally rectangular opening.

13. The method of claim 12, which further comprises the step of removing any gypsum board wall sheathing within the closet space.

14. The method of claim 12, which further comprises the step of widening the generally rectangular opening to more nearly coincide with an interior width dimension of the closet space.

15. The method of claim 12, which further comprises the step of raising the height of the generally rectangular opening to more nearly coincide with an interior height dimension of the closet space.

16. The method of claim 12, which further comprises the step of attaching exterior trim pieces to outer edges of the armoire, said trim pieces covering a gap between the armoire and said generally rectangular opening.

17. The method of claim 12, which further comprises the step of providing at least one cavity equipped with a horizontal pole, from which clothes may be suspended on hangars.

18. The method of claim 17, wherein said armoire has at least one rear panel, and said horizontal pole is parallel to said at least one rear panel.

19. The method of claim 17, wherein said armoire has at least one rear panel and at least two horizontal poles perpendicular to said at least one rear panel, and said horizontal pole is part of a pull-out clothes hanger pole assembly having a horizontally-slideable pole assembly.

20. The method of claim 19, wherein said pull-out clothes hanger pole assembly is attached to a horizontal panel of the armoire and has full-extension glides which permit the horizontally-slideable pole assembly to be extended completely outside the armoire.

* * * * *